US007968132B2

(12) United States Patent
Archie, Jr.

(10) Patent No.: US 7,968,132 B2
(45) Date of Patent: Jun. 28, 2011

(54) DUAL COMPARTMENT SANDWICH CONTAINERS HAVING A HINGED DIVIDER AND REMOVABLE HOT/COLD PACK

(75) Inventor: Will N. Archie, Jr., San Mateo, CA (US)

(73) Assignee: Contain This!, LLC, San Mateo, CA (US)

( * ) Notice: Subject to any disclaimer, the term of this patent is extended or adjusted under 35 U.S.C. 154(b) by 1801 days.

(21) Appl. No.: 10/640,759

(22) Filed: Aug. 15, 2003

(65) Prior Publication Data

US 2005/0037113 A1 Feb. 17, 2005

(51) Int. Cl.

| | |
|---|---|
| ***B65D 81/18*** | (2006.01) |
| ***B65D 81/32*** | (2006.01) |
| ***B65D 6/00*** | (2006.01) |
| ***A45C 11/20*** | (2006.01) |

(52) U.S. Cl. ..... 426/109; 426/120; 206/546; 206/541; 220/4.22; 220/4.24

(58) Field of Classification Search ..... 426/115, 426/120, 124, 109; 206/541, 546, 549, 545, 206/542; 220/4.01, 4.21–4.27, 520, 521, 220/526, 528, 529, 231, 503, 504, 507; 229/902, 229/906, 120.21, 120.32

See application file for complete search history.

(56) References Cited

U.S. PATENT DOCUMENTS

| | | | | | |
|---|---|---|---|---|---|
| 2,457,043 | A | * | 12/1948 | Histand | 220/592.2 |
| 2,458,837 | A | * | 1/1949 | Dougherty | 219/387 |
| 2,504,911 | A | * | 4/1950 | Whitecar | 62/457.2 |
| 2,545,127 | A | * | 3/1951 | Wnuk | 219/387 |
| 2,645,332 | A | * | 7/1953 | Martin et al. | 206/545 |
| 3,026,995 | A | * | 3/1962 | Slaughter | 206/541 |
| 3,360,153 | A | * | 12/1967 | Wheaton, Jr. | 220/4.21 |
| 3,387,650 | A | * | 6/1968 | Masshake et. al. | 165/75 |
| 3,567,013 | A | * | 3/1971 | Tannebaum | 206/538 |
| 4,050,264 | A | * | 9/1977 | Tanaka | 62/457.2 |
| 4,238,934 | A | * | 12/1980 | Hotta | 62/457.2 |
| 4,351,165 | A | * | 9/1982 | Gottsegen et al. | 62/371 |
| D274,889 | S | * | 7/1984 | Sullivan | D9/426 |
| 4,630,671 | A | * | 12/1986 | Sherman et al. | 165/61 |
| 4,771,761 | A | * | 9/1988 | Doukhan et al. | 126/263.09 |

(Continued)

OTHER PUBLICATIONS

Definition of Dome. www.xreferplus.com, 2003.*

*Primary Examiner* — Rena L Dye
*Assistant Examiner* — Viren Thakur
(74) *Attorney, Agent, or Firm* — Morland C. Fischer

(57) ABSTRACT

A durable, reusable dual compartment sandwich container having upper and lower compartments that are pivotally connected to one another and separated by a rotatable divider. One or more slices of bread or an elongated sandwich roll is carried within the upper compartment and the ingredients for a sandwich are carried in the lower compartment. The divider is rotated over top of the lower compartment so as to segregate the wet ingredients from the dry bread and thereby prevent the bread from becoming soggy. A removable hot/cold pack is also carried within the lower compartment to provide heat or cold to the sandwich ingredients over a prolonged period of time in order to avoid the premature spoilage of the ingredients prior to consumption. In one embodiment, each of the upper and lower compartments, the divider and the hot/cold pack is shaped to resemble a slice of bread, so that in the closed configuration, the overall appearance of the sandwich container is that of a sandwich, whereby to provide a visual indication of the intended use thereof.

7 Claims, 7 Drawing Sheets

U.S. PATENT DOCUMENTS 4,844,330 A * 7/1989 Roosa et al. ..... 229/120.06
4,951,866 A * 8/1990 Rusnak ..... 229/120.07
5,012,971 A * 5/1991 Cozzi et al. ..... 229/120.07
5,259,506 A * 11/1993 Pascale et al. ..... 206/545
5,277,329 A * 1/1994 Pomroy et al. ..... 220/526
5,323,926 A * 6/1994 Pomroy et al. ..... 220/526
5,325,969 A * 7/1994 Gordon et al. ..... 206/546
5,462,192 A * 10/1995 Pomroy et al. ..... 220/526
RE35,437 E * 2/1997 Ascone ..... 62/372
5,792,213 A * 8/1998 Bowen ..... 607/96
5,842,571 A * 12/1998 Rausch ..... 206/549
5,975,334 A * 11/1999 Mayo ..... 220/592.03

* cited by examiner

DUAL COMPARTMENT SANDWICH CONTAINERS HAVING A HINGED DIVIDER AND REMOVABLE HOT/COLD PACK

BACKGROUND OF THE INVENTION

1. Field of the Invention

This invention relates to reusable sandwich containers having the overall appearance of a sandwich or a sandwich roll and including upper and lower compartments that are separated from one another by a rotatable divider so that one or more pieces of bread or an elongated roll can be carried in the upper compartment and isolated from the wet ingredients or fixings for a sandwich to be carried in the lower compartment. A removable hot/cold pack is also carried within the lower compartment to provide the ingredients with heat or cold as needed to preserve the freshness and prevent the premature spoilage thereof.

2. Background Art

Compartmented food containers are known in the art as exemplified by U.S. Pat. Nos. 4,844,330, 4,951,866, 5,277,329, 5,323,926 and 5,325,969. However, none of the conventional food containers is adequate for the purpose of protecting a sandwich and its ingredients from losing their freshness and spoiling in a relatively short time, especially in warm weather. Although some of the conventional food containers are known to include ice cubes or an insulating material, no food container is known which is specifically adapted to isolate the relatively dry bread from the relatively wet sandwich ingredients or fixings in separate compartments so as to prevent the bread from becoming soggy and inedible between the time that the sandwich container is initially packaged and the time that the sandwich is ultimately assembled for consumption. More particularly, no sandwich container is known which has the overall configuration of a sandwich and the ability to segregate the bread from the ingredients and to prevent the transfer of moisture or heat therebetween. In this same regard, no sandwich container is known which includes a removable and reusable source of heat or cold which is capable of preventing the contents of the sandwich from losing their freshness or spoiling over a prolonged period of time.

SUMMARY OF THE INVENTION

In general terms, a dual compartment sandwich container is disclosed according to a first embodiment having the overall appearance of a typical sandwich. The sandwich container includes hollow upper and lower compartments that are pivotally connected to one another by means of a living hinge. Each of the upper and lower compartments of the sandwich container is shaped to resemble a slice of bread, whereby the upper compartment can conveniently carry one or more pieces of bread and the lower compartment can carry the ingredients or fixing of the sandwich. In order to isolate the upper and lower compartments from one another and thereby prevent the migration of liquids and moisture from the lower compartment to the upper compartment, a divider is located therebetween. The divider is pivotally connected to the lower compartment and rotatable between a raised position, spaced above the lower compartment, and a seated position, at which to cover the lower compartment. The divider is characterized by a low thermal conductivity to prevent the transfer of heat or cold (that is associated with the ingredients of the sandwich) from the lower compartment to the bread carried in the upper compartment. The sandwich container is manufactured from a relatively rigid and optically transparent material so as to provide visual access to the contents thereof while permitting the container to be efficiently cleaned and then reused.

A hot/cold pack is carried by the lower compartment of the sandwich container so as to lie in thermal communication with the sandwich ingredients therein. The hot/cold pack is adapted to retain heat or cold for a prolonged period of time after first being heated or cooled (e.g., in a microwave oven or a freezer). By virtue of the hot/cold pack, it is possible to preserve the freshness of the sandwich ingredients within the lower compartment and prevent the premature spoilage thereof prior to the sandwich being assembled and consumed. A pull tab is provided by which the hot/cold pack can be easily lifted out of the lower compartment and removed from the sandwich container.

According to a second embodiment, a dual compartment sandwich container is disclosed having an oval shape that is typical of a "French" roll. The sandwich container includes hollow upper and lower compartments that are pivotally connected to one another by means of a living hinge. The upper compartment is sized so as to carry therein an elongated sandwich roll. The lower compartment is separated into a pair of side pockets by a laterally extending wall. The side pockets are sized so that the wet fixings or ingredients of the sandwich are carried in one side pocket and a condiment is carried in the other side pocket. In order to isolate the upper and lower compartments from one another and thereby prevent the migration of liquids and moisture from the lower compartment to the upper compartment, a dish shaped divider is located therebetween. The divider is pivotally connected to the lower compartment and rotated between an axially extended position, projecting outwardly from the lower compartment, and a seated position at which to cover the lower compartment. A hot/cold pack is carried by one of the side pockets formed in the lower compartment of the sandwich container so as to lie in thermal communication with the sandwich ingredients. By virtue of the hot/cold pack, it is possible to preserve the freshness of the sandwich ingredients within the lower compartment and prevent a premature spoilage thereof.

DETAILED DESCRIPTION

Figure 1:
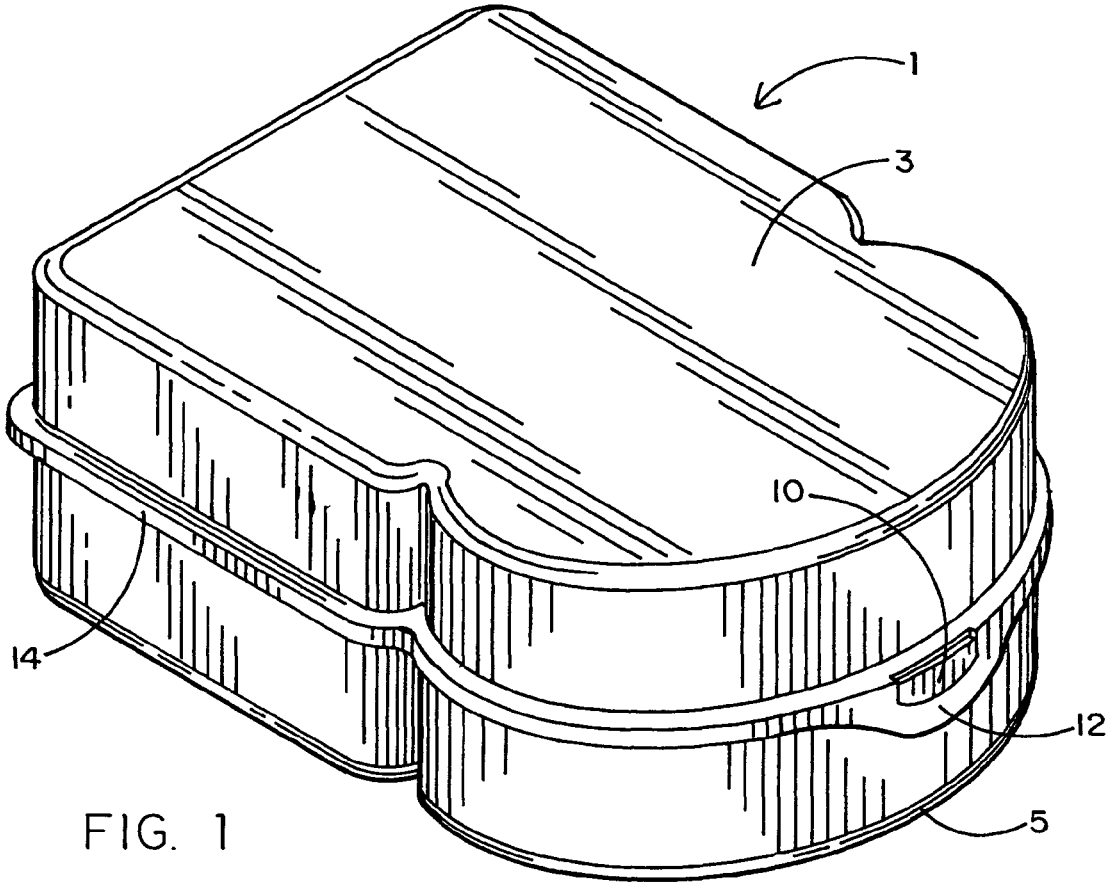
FIG. 1 is a perspective view of a reusable dual compartment sandwich container according to a first embodiment in a closed configuration having the overall appearance of a sandwich.
Figure 2:
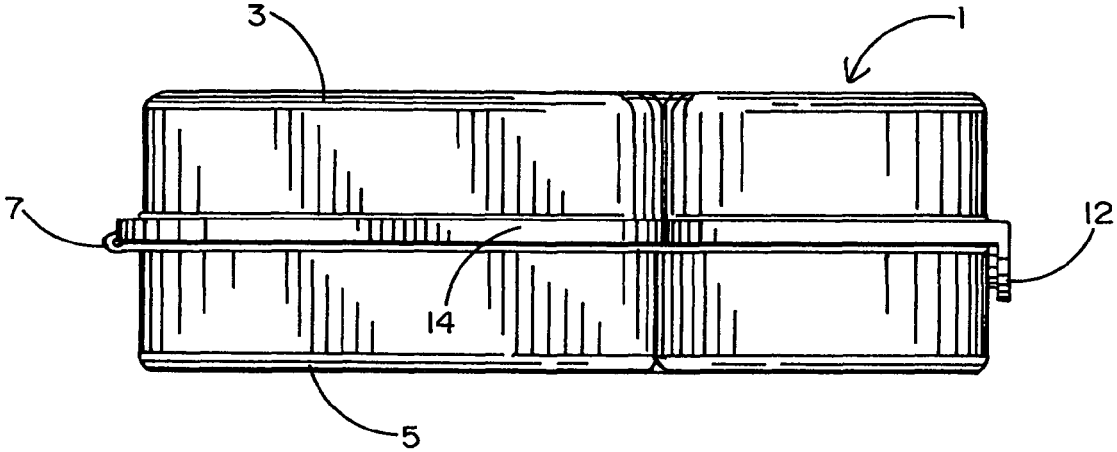
FIG. 2 is a side view of the dual compartment sandwich container in the closed configuration of FIG. 1.

The dual compartment sandwich container 1 of this invention will now be described while referring initially to FIGS. 1-3 of the drawings, where a durable container is shown having the overall appearance of a typical sandwich. The shape of container 1 is particularly useful so as to receive and transport one or more slices of bread and the ingredients by which to make a sandwich and to provide a visual indication of the intended use of the container. To this end, the sandwich container 1 is preferably manufactured from a relatively rigid, transparent (i.e., see through) plastic material to enable the user to have visual access to the contents thereof while protecting the contents from being crushed during handling and transport of the container. What is more, the sandwich container 1 may be advantageously cleaned after each use and then reused so as to eliminate waste.

Figure 3:
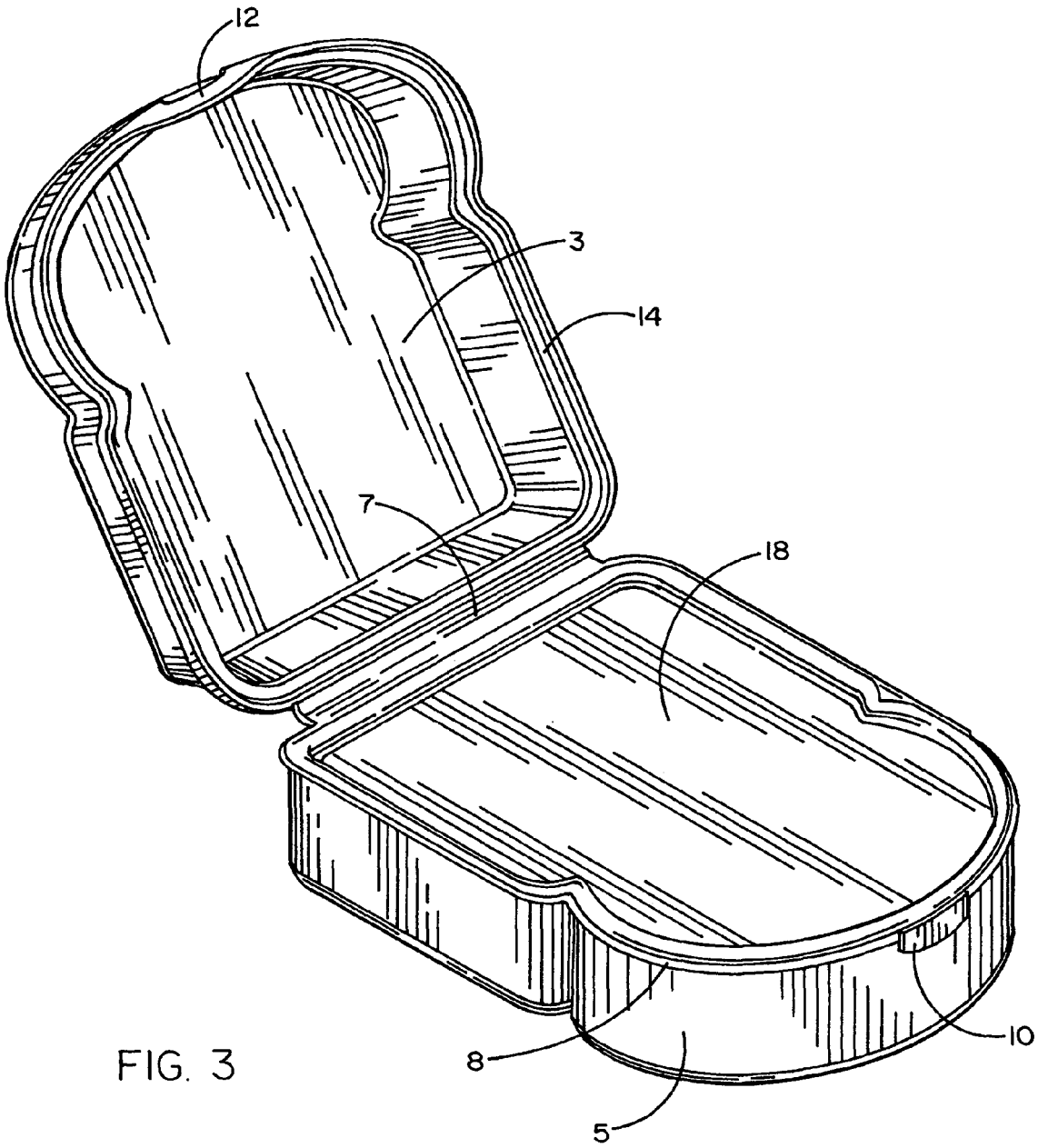
FIG. 3 shows the dual compartment sandwich container in an open configuration with a divider seated upon a lower compartment of the container to isolate the lower compartment from an upper compartment of the container.

The dual compartment sandwich container 1 includes hollow upper and lower compartments 3 and 5 that are pivotally connected to one another along respective rear edges by means of a living hinge 7 extending therebetween (best shown in FIG. 3). Although each of the upper and lower compartments 3 and 5 has the shape of a slice of bread, and as will be described in greater detail when referring to FIG. 6, the upper compartment 3 is intended to hold one or more pieces of bread while the lower compartment 5 is intended to hold the ingredients or fixings of a sandwich to be combined with the bread in upper compartment 3 in order to make the sandwich ready for consumption.

The lower compartment 5 of dual compartment sandwich container 1 has an outwardly projecting lip 8 that extends around the periphery thereof (also best shown in FIG. 3). A tab 10 is formed in the lip 8 at the front of lower compartment 5 to be captured by a clasp 12 from the upper compartment 3 by which to hold the sandwich container 1 in the closed configuration of FIGS. 1 and 2. The upper compartment 3 also has a peripheral lip 14 extending therearound with the aforementioned clasp 12 depending downwardly therefrom. The lip 14 of upper compartment 3 is sized to surround the lip 8 of lower compartment 5 when the upper compartment 3 is rotated around hinge 7 to the closed configuration at which time the upper compartment 3 will be positioned above and detachably connected to the lower compartment 5 with the clasp 12 of upper compartment 3 moved into receipt of the tab 10 in the lip 8 of lower compartment 3 and into interlocking engagement therewith.

Figure 4:
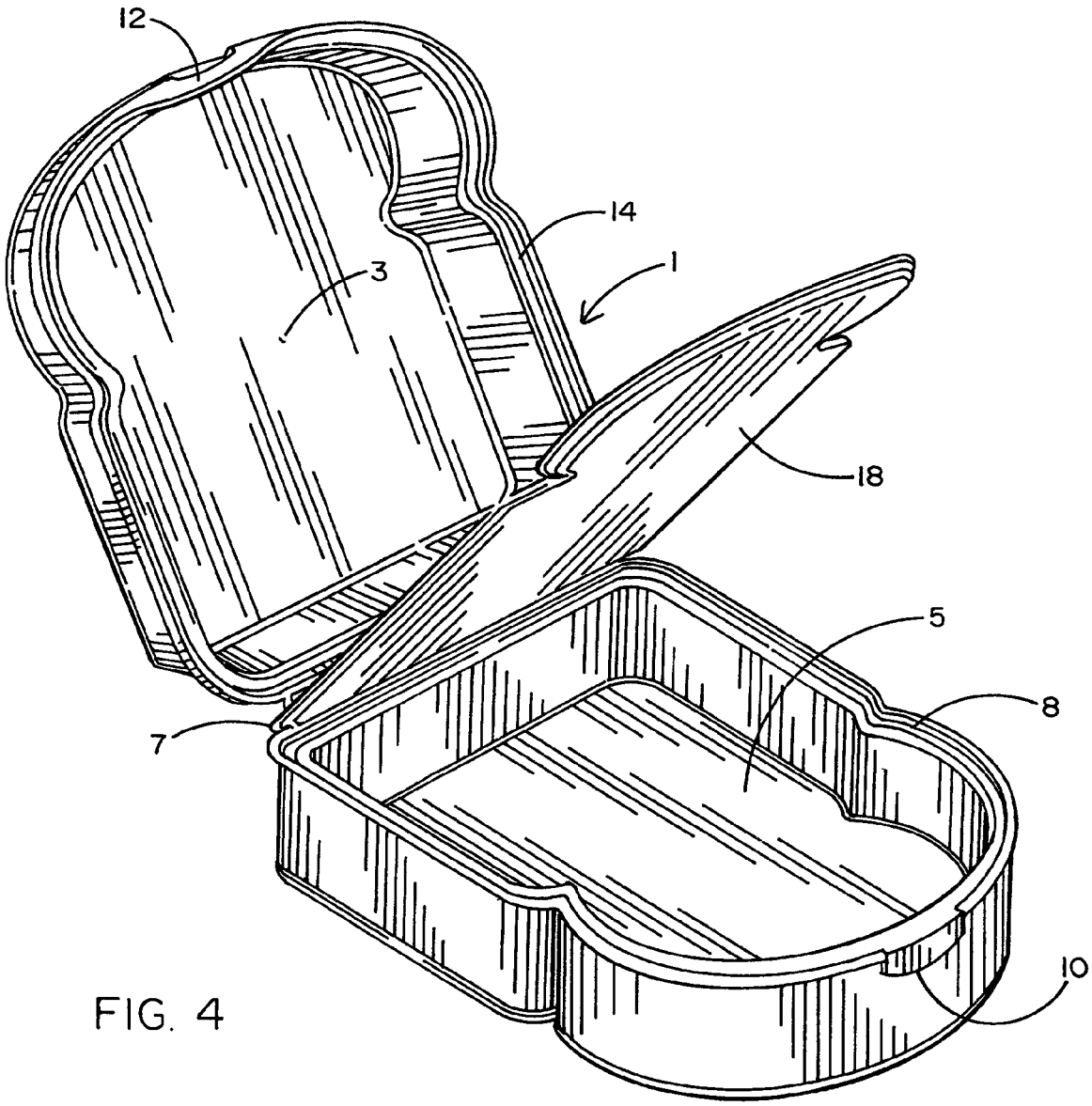
FIG. 4 shows the dual compartment sandwich container in the open configuration with the divider rotated to a raised position between the upper and lower compartments of the container.

Turning now to FIG. 4 of the drawings, the dual compartment sandwich container 1 is shown having a divider 18 that is located between the upper and lower compartments 3 and 5 by which the dry pieces of bread to be carried in the upper compartment 3 can be segregated from the wet ingredients to be carried in the lower compartment 5 so as to prevent the migration of liquids (e.g., salad dressing, condiments, or the like) and moisture therebetween. In the embodiment shown in FIG. 4, the divider 18 is pivotally interconnected along its rear edge with the rear edges of the upper and lower compartments 3 and 5 at the living hinge 7. In an alternate embodiment shown in FIG. 5, the divider 18 is pivotally connected along a side edge thereof with a corresponding side edge of the lower compartment 5 by means of another living hinge 20 extending therebetween.

The divider 18 is adapted to be rotated between a raised position so as to be spaced above the lower compartment 5 (best shown in FIGS. 4 and 5) and a seated position lying atop the lower compartment 5 (best in FIG. 3). The divider 18 has the identical shape of a slice of bread and a corresponding size, so that in the seated position of FIG. 3, the divider 18 will be supported by the peripheral lip 8 of the lower compartment 5. With the sandwich container 1 in the closed configuration of FIGS. 1 and 2, the divider 18 will be covered by the upper compartment 3 and disposed between the upper and lower compartments 3 and 5, whereby to form a moisture-tight barrier to isolate one compartment from the other. The divider 18 is preferably characterized by a low thermal conductivity to prevent the transfer of heat or cold from the lower compartment 5 to the pieces of bread carried in the upper compartment 3 for a purpose that will soon be explained.

Figure 5:
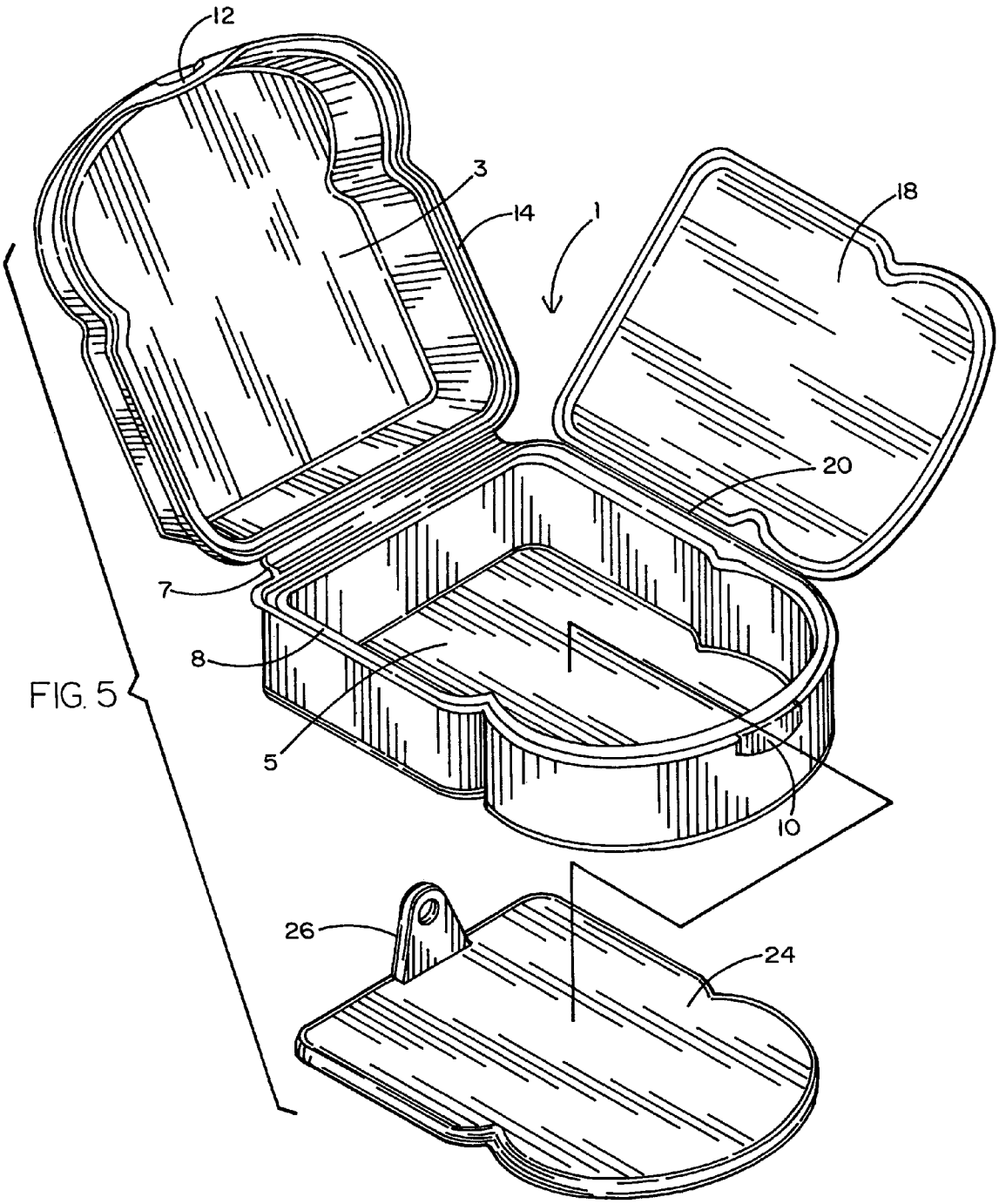
FIG. 5 shows an alternate embodiment of the dual compartment sandwich container of FIG. 4 also including a hot/cold pack to be removably received within the lower compartment of the container.

An important aspect of this invention is now disclosed while referring to FIG. 5 of the drawings. More particularly, the sandwich container 1 is provided with a hot or cold pack 24. The hot/cold pack 24 has the same shape (i.e., that resembling a slice of bread) as the bottom compartment 5 and is sized to be removably received therewithin. The hot/cold pack 24 contains a material (e.g., a gel) that is adapted to maintain a high or low temperature over an extended period of time after first being heated or cooled. By way of example, one suitable material that will maintain a low temperature for a long time after first being frozen is that manufactured by Rubbermaid and sold commercially as Blue Ice. Another suitable material that is capable of maintaining either a high or a low temperature is that manufactured by True-Fit and sold commercially as I.C.E./Hot Reusable Gelpack. In this same regard, the material can be heated in a microwave oven or boiled in water in order to store heat to be released over time.

Figure 6:
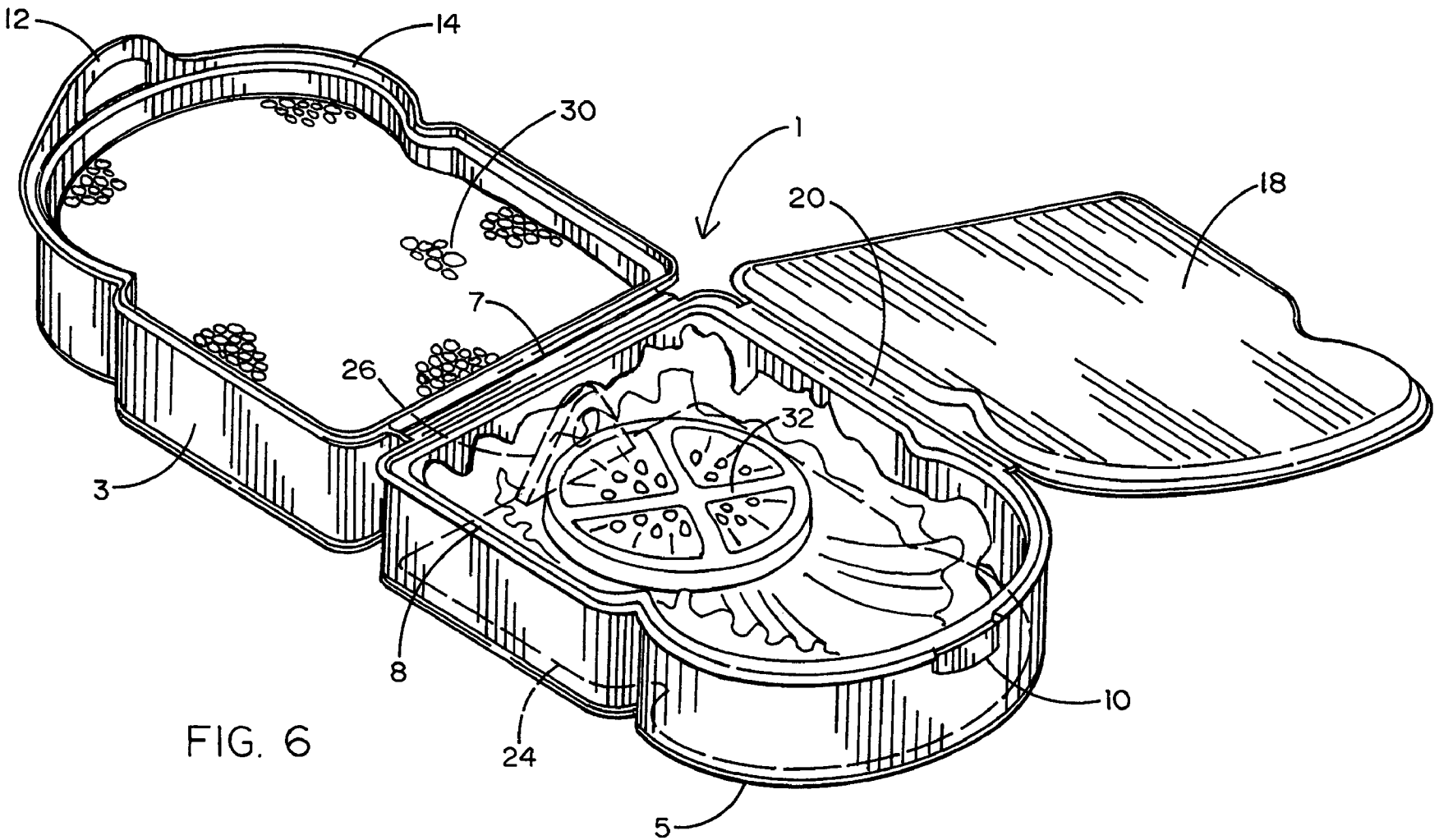
FIG. 6 shows the dual compartment sandwich container in the open configuration with one or more slices of bread carried by the upper compartment and the ingredients for a sandwich carried by the lower compartment.

It is preferable that the hot/cold pack 24 be carried within the lower compartment 5 of the dual compartment sandwich container 1 so as to lie in thermal contact with the sandwich ingredients therein. In the case where the sandwich ingredients are cold meat and/or vegetables (as shown in FIG. 6), a cold pack 24 will be employed for receipt by the lower compartment 5 to maintain a low temperature and thereby prevent the possible spoilage of the ingredients. By making the shape of the hot/cold pack 24 conform to the shape of the lower compartment 5 resembling a slice of bread, the ingredients of the sandwich within lower compartment 5 can be uniformly heated or cooled while advantageously avoiding any hot or cold spots so as to better preserve the freshness thereof. Moreover, the hot/cold pack 24 can be snapped within and detachably connected to the bottom compartment 5.

To enable the hot/cold pack 24 to be easily removed from the lower compartment 5, such as when it becomes necessary for the sandwich container 1 to be cleaned, a pull-tab 26 is provided atop pack 24. The user simply grasps the pull-tab 26 and applies an upward pulling force thereto, whereby the hot/cold pack 24 will be lifted out of the lower compartment 5 and removed from the container 1 so as to be later returned thereto for subsequent use or for purposes of storage during non-use.

FIG. 6 of the drawings shows the dual compartment sandwich container 1 in the open configuration loaded with the bread and ingredients necessary to make a sandwich. That is, and as was earlier disclosed, one or more pieces of bread 30 are placed into the upper compartment 3 and the hot or cold ingredients 32 of the sandwich are placed into the lower compartment 5. In the example of FIG. 6, the ingredients 32 of the sandwich are cold (e.g., lettuce and tomato). Therefore, a cold pack 24 will first be placed within the lower compartment 5 to keep the ingredients 32 fresh and crisp. The divider 18 is now rotated around hinge 20 to the seated position above the ingredients 32 in the lower compartment 5, and the upper compartment 3 is then rotated around hinge 7 to the closed configuration (of FIGS. 1 and 2) over top of the divider 18 and the lower compartment 5. In the closed configuration, the sandwich container 1 is compact in size so as to be ideally suited to be carried in a handbag, briefcase, or even a coat pocket while preventing the bread 30 from absorbing moisture and protecting the contents against degradation until such time as the user is ready to assemble and consume the sandwich.

With the dual compartment sandwich container 1 held in the closed configuration by means of clasp 12, a reliable transport is provided to prevent the contents from spilling or falling out therefrom. The hot/cold pack 24 ensures the desired temperature integrity of the ingredients 32 within lower compartment 5 throughout the time between preparation and consumption. The divider 18 segregates the dry bread 30 from the wet ingredients 32 within separate upper and lower compartments 3 and 5 so as to prevent the bread from becoming soggy and inedible. The durable, relatively rigid nature of the container 1 protects the contents from being crushed during transport and facilitates the easy cleaning and reuse thereof. Leftover portions of the contents can be returned to the upper and/or lower compartments 3 and 5 and refrigerated in the sandwich container 1 to await consumption in the future. The unique overall appearance of the container 1 resembling a sandwich visually identifies the intended use and immediately suggests to the consumer that slices of bread are to be located in at least one of the dual compartments thereof.

Figure 7:
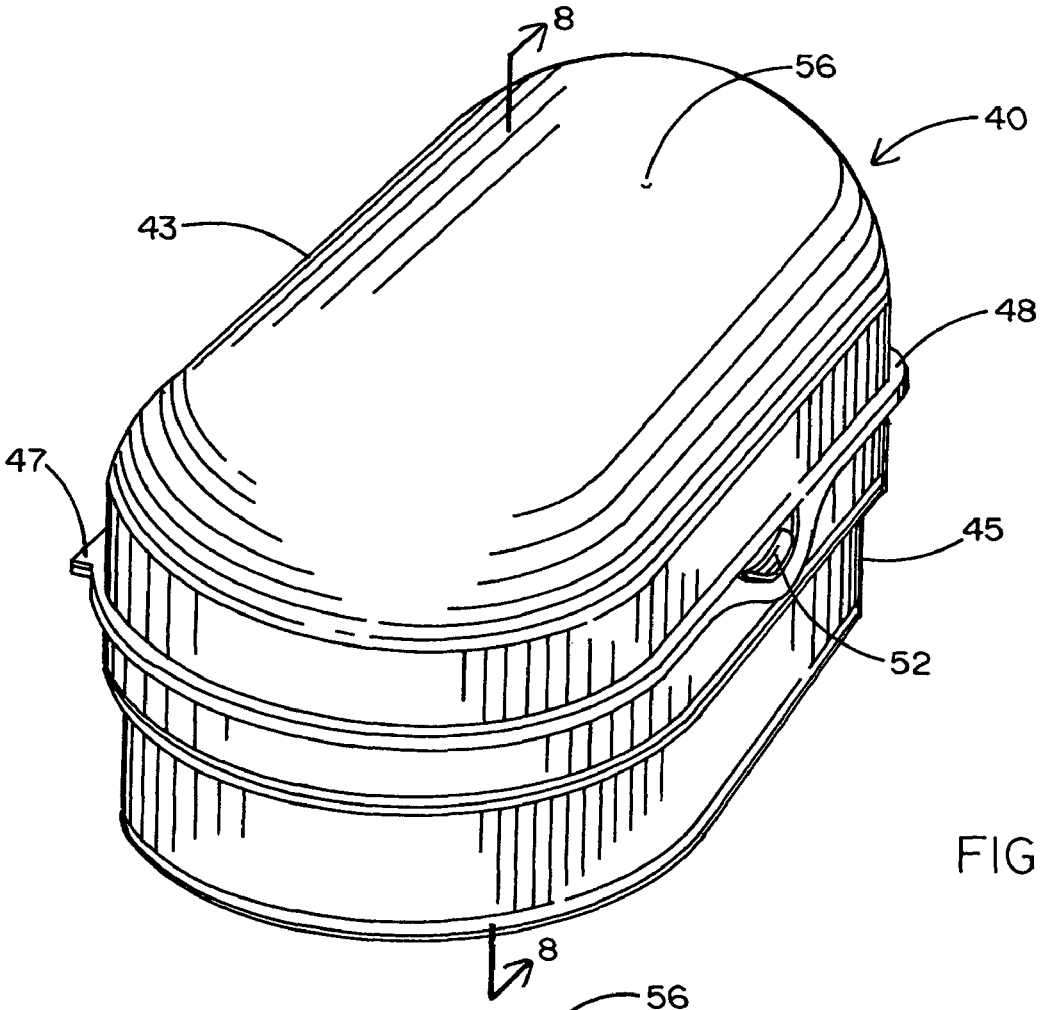
FIG. 7 is a perspective view of a reusable dual compartment sandwich container according to an alternate embodiment in a closed configuration having an oval shape typical of a sandwich roll.
Figure 8:
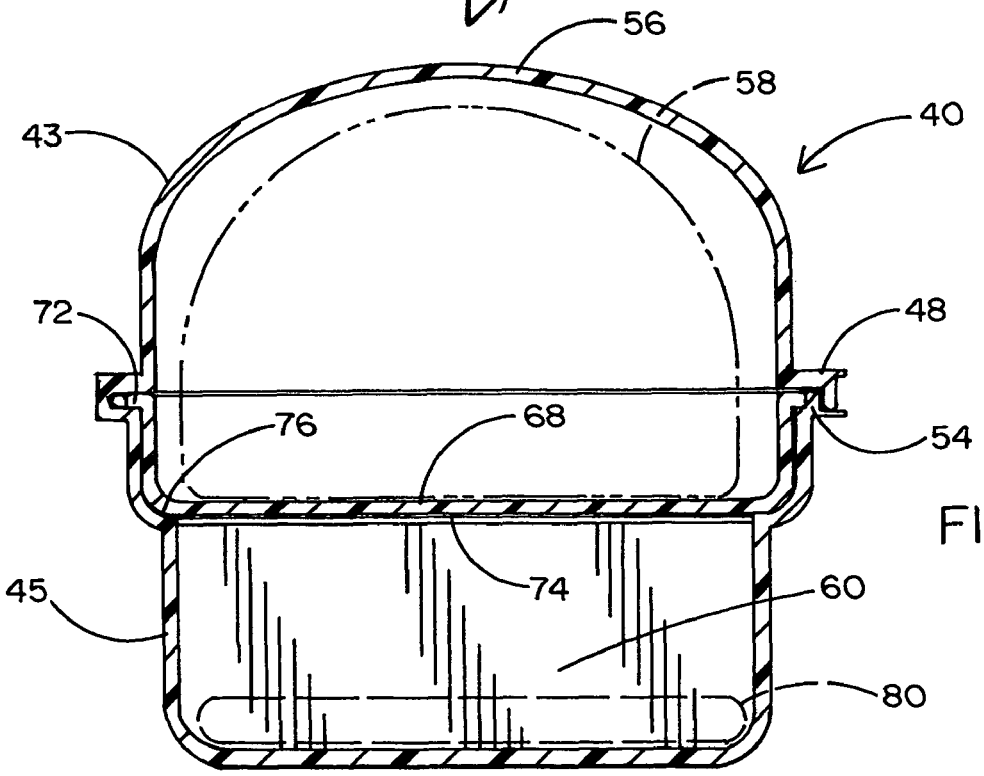
FIG. 8 is a cross-section taken along lines 8-8 of FIG. 7.
Figure 9:
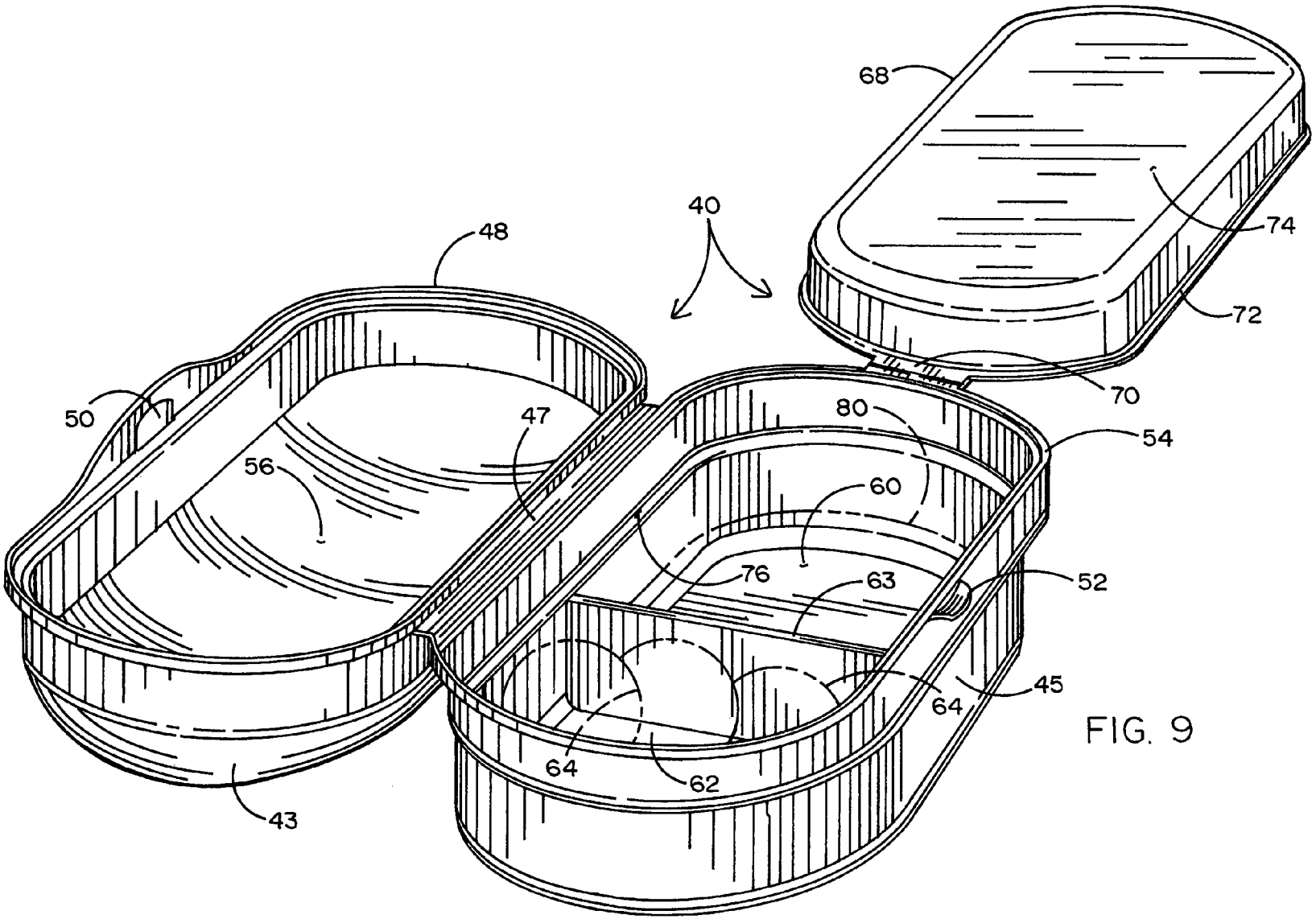
FIG. 9 shows the dual compartment sandwich container of FIG. 7 in an open configuration with a divider projecting outwardly and axially outward from a lower one of the compartments.

FIGS. 7-9 of the drawings show another dual compartment sandwich container 40 according to an alternate embodiment of this invention which has particular application in transporting sandwiches of the type containing "French" rolls (e.g. such as those sandwiches commonly known as heroes, hoagies, submarines, etc.). Thus, while the sandwich container 1 of FIGS. 1-6 is ideally suited for transporting sandwiches that are made from one or more slices of bread, the sandwich container 40 of FIGS. 7-9 is especially suited for transporting sandwiches that are made from an elongated sandwich roll, or the like. Like the container 1, the sandwich container 40 may be manufactured from a relatively rigid, transparent plastic material that may be conveniently cleaned and then reused.

The dual compartment sandwich container 40 includes generally oval shaped upper and lower compartments 43 and 45 that are pivotally connected to one another along their respective opposing sides by means of a living hinge 47. The upper compartment 43 has a wide lip 48 extending around the periphery thereof. An opening 50 is formed through the lip 48 at the front of upper compartment 43 to accommodate therethrough a tab 52 that projects outwardly from the front of the lower compartment 45 by which to hold the sandwich container 40 in the closed configuration of FIGS. 7 and 8. The lower compartment 45 also has a wide peripheral lip 54 extending therearound. The lip 48 of upper compartment 43 is sized to surround the lip 54 of lower compartment 45 when the upper compartment 43 is rotated around hinge 47 to the closed configuration of FIG. 8, at which time the upper compartment 43 will be positioned above and detachably connected to the lower compartment 45 with the tab 52 of lower compartment 45 moved through the opening 50 in the upper compartment 43 and into interlocking engagement therewith.

The upper compartment 43 of the dual compartment sandwich container 40 includes a dome or arcuate shaped top 56 that is configured so as to accommodate a French or similar type roll (designated 58 and shown in phantom lines in FIG. 8) therewithin. The lower compartment 45 of dual compartment sandwich container 40 includes a pair of side pockets 60 and 62 that are separated from one another by a laterally extending wall 63. As will soon be explained, one of the side pockets (e.g. 60) can receive the wet fixings or ingredients of the sandwich, while the other side pocket 62 can receive any one of a variety of condiments, such as that represented by the phantom lines 64.

As is best shown in FIG. 9, the dual compartment sandwich container 40 includes a divider 68 that, in the closed container configuration of FIG. 8, will be located between the upper and lower compartments 43 and 45 by which the dry roll to be carried in the upper compartment 43 will be segregated from the wet ingredients and condiments to be carried in the side pockets 60 and 62 of lower compartment 45. In the embodiment shown in FIG. 9, the divider 68 is pivotally interconnected along its rear edge with the rear edge of the lower compartment 45 by means of a hinge 70.

The divider 68 is adapted to be rotated around the hinge 70 from an axially extended position as shown in FIG. 9 to a seated position (best shown in FIG. 8) lying atop the lower compartment 45. The divider 68 has a generally oval shape corresponding to the shape of the lower compartment 45. The divider 68 has an outer peripheral lip 72 extending around the exterior thereof and a flat bottom 74 that is recessed below the peripheral lip 72 to provide divider 68 with a "deep dish" capacity by which to support the roll to be carried in upper compartment 43. With the sandwich container 40 in the closed configuration of FIGS. 7 and 8, the divider 68 will be rotated over the lower compartment 45 to assume the seated position. In the seated position, the dome 56 of upper compartment 43 will lie opposite the flat bottom 74 of divider 68 so as to surround the roll 58. The peripheral lip 72 around the exterior of divider 68 will be received against and seated upon an inwardly projecting ledge 76 that extends around the periphery of lower compartment 45 (best shown in FIG. 8). In this case, the divider 68 will be covered by the upper compartment 43 and disposed between the upper and lower compartments 43 and 45, whereby to form a moisture tight barrier to isolate one compartment from the other. In this regard, the divider 68 is preferably characterized by a low thermal conductivity to prevent the transfer of heat or cold from the wet ingredients in the lower compartment 45 to the roll to be carried in the upper compartment 43.

Like the sandwich container 1 described above, the dual compartment sandwich container 40 is provided with a hot or cold pack 80 (shown in phantom lines in FIGS. 8 and 9). In this embodiment, the hot/cold pack 80 is carried in the side pocket 60 of the lower compartment 45 so as to lie adjacent and in thermal contact with the sandwich ingredients, whereby to maintain a suitable temperature and thereby prevent the ingredients from spoiling prematurely. By making the shape of hot/cold pack 80 conform to the shape of side pocket 60, the hot/cold pack 80 can be snapped in place and detachably connected to the lower compartment 45 of sandwich container 40. The separating wall 63 that extends laterally across the bottom compartment 45 isolates the hot/cold pack 80 within side pocket 60 from any condiments 64 that are carried within the opposite side pocket 62. Like the hot/cold pack 24 shown in FIG. 5, the hot/cold pack 80 of FIGS. 8 and 9 ensures the desired temperature integrity of the ingredients carried within the side pocket 60 of lower compartment 45 throughout the time between preparation and consumption of the sandwich.

I claim:

1. In combination:

bread for making a sandwich;

ingredients to be used with said bread for making a sandwich; and a dual compartment sandwich container, comprising:

an upper compartment to receive and carry all of the sandwich bread therewithin;

a lower compartment pivotally connected to said upper compartment to receive and carry all of the sandwich ingredients therewithin, said upper compartment being rotatable between open and closed positions relative to said lower compartment;

a divider fixedly connected to said lower compartment by means of a first hinge, said divider adapted to be rotated over top of said lower compartment independently of the rotation of said upper compartment to form a moisture-tight barrier between said upper and lower compartments and thereby segregate all of the sandwich ingredients in said lower compartment from all of the sandwich bread in said upper compartment by preventing the migration of water and liquids from said lower compartment to said upper compartment;

said upper compartment having a dome to accommodate the sandwich bread thereunder and said divider having a recess that extends into said lower compartment such that said recess lies opposite said dome so as to receive and support the sandwich bread thereupon, said sandwich bread being located between the dome of said upper compartment and the recess of said divider; and a hot/cold pack containing a thermal material that is adapted to be either heated or refrigerated and retain heat or cold for a prolonged period of time, said hot/cold pack being removably received within said lower compartment so as to lie below and in thermal contact with the sandwich ingredients to prevent the premature spoilage of such ingredients.

2. The combination recited in claim 1, wherein each of the upper and lower compartments of said dual compartment sandwich container has an identical shape so as to be adapted to receive said sandwich bread and said sandwich ingredients therewithin.

3. The combination recited in claim 1, wherein each of said hot/cold pack and the lower compartment of said dual compartment sandwich container has an identical shape.

4. The combination recited in claim 1, wherein said dual compartment sandwich container is manufactured from a material so as to be washed and reused.

5. The combination recited in claim 1, wherein said dual compartment sandwich container also comprises a clasp depending from said upper compartment to engage said lower compartment to hold said sandwich container in the closed position.

6. The combination recited in claim 1, wherein said hot/cold pack includes a pull tab connected thereto, such that a pulling force applied to said pull tab causes said hot/cold pack to be lifted out of said lower compartment and removed from said dual compartment sandwich container.

7. The dual compartment sandwich container recited in claim 1, wherein said upper and lower compartments are pivotally connected to one another by means of a second hinge.

* * * * *